US006155141A

United States Patent [19]

Baker

[11] Patent Number: 6,155,141

[45] Date of Patent: Dec. 5, 2000

[54] DOUBLE DRIVE OPEN-END WRENCH

[75] Inventor: David R. Baker, Fort Worth, Tex.

[73] Assignee: David Baker, Inc., Fort Worth, Tex.

[ * ] Notice: This patent is subject to a terminal disclaimer.

[21] Appl. No.: 09/176,593

[22] Filed: Oct. 21, 1998

Related U.S. Application Data

[60] Provisional application No. 60/062,732, Oct. 22, 1997.

[51] Int. Cl.[7] ..... B25B 13/02

[52] U.S. Cl. ..... 81/119; 81/124.3

[58] Field of Search ..... 81/119, 124.3, 81/124.7, 186

[56] References Cited

U.S. PATENT DOCUMENTS

| | | | |
|---|---|---|---|
| 4,889,020 | 12/1989 | Baker . | |
| 5,117,714 | 6/1992 | Pagac et al. | 81/121.1 X |
| 5,131,312 | 7/1992 | Macor | 81/186 X |
| 5,239,899 | 8/1993 | Baker . | |
| 5,381,710 | 1/1995 | Baker . | |
| 5,406,868 | 4/1995 | Foster | 81/186 |

*Primary Examiner*—Derris H. Banks
*Assistant Examiner*—Anthony H. Ojini
*Attorney, Agent, or Firm*—Felsman, Bradley, Vaden, Gunter & Dillon, L.L.P.; James E. Bradley

[57] ABSTRACT

An wrench for use with a nut which protects the nut from damage as torque is applied and can drive the nut in two drive positions. The wrench of this invention has a head having an upper forward drive face opposed to a lower drive face and an upper rearward drive face adjacent to the upper forward drive face. An upper notch separates the upper forward drive face and the upper rearward drive face. There is a back stop face adjacent to the upper rearward drive face. The lower drive face is adapted to engage a first side of a nut, the upper rearward drive face is adapted to engage an opposed second side of the nut, and the back stop face is adapted to engage a corner of the nut when the wrench is in a primary drive position. The upper forward drive face is adapted to engage the first side of the nut, the upper notch is adapted to engage a nut corner adjacent to the first side, and the lower drive face is adapted to engage the second side when the wrench is in a secondary drive position.

17 Claims, 3 Drawing Sheets

DOUBLE DRIVE OPEN-END WRENCH

This application claims the benefit of U.S. Provisional Application 60/062,732, filed Oct. 22, 1997.

This application is filed simultaneously with a patent application titled "Triple Drive Open-End Wrench" by David R. Baker.

FIELD OF THE INVENTION

This invention relates in general to wrenches, and in particular to an open end wrench that provides two surfaces upon which to drive a nut.

DESCRIPTION OF THE PRIOR ART

In a conventional open end wrench, a rigid jaw having flat parallel faces slides over a nut and attempts to engage fully, the flat parallel nut sides. However, because typical hexagonal nuts are built within manufacturing tolerances, a practical wrench must be designed to accommodate variations in the spacing of parallel sides that may be encountered within a nominal nut size. This necessitates clearances between the parallel sides of the nut and the parallel faces of the wrench. These clearances cause the flat parallel faces to engage primarily the nut corners rather than the whole side and may cause the nut corners to become rounded off if torque is applied to the nut with less than perfect wrench to nut contact. This problem is exacerbated when the user cannot or does not slide the wrench completely over the nut and drives the nut with the tips of the wrench jaw. A nut whose corners have been rounded off cannot be driven by a conventional wrench. Further, many times it may be desirable to drive the nut with the tips of the wrench jaw to save the time of having to seat the wrench fully for each stroke or because space does not allow the wrench to seat fully on the nut.

A number of patents have dealt with the tendency of a conventional wrench to engage the corners of a nut by using arcuate surfaces in lieu of flat parallel surfaces. The arcuate surfaces curve away from the nut corners and engage the nut closer to nut side center. Unfortunately, however, in the same way the arcuate surfaces protect the nut corners, they prevent driving of the nut with the wrench tips. The arcuate surfaces curve away from the nut at the wrench tips, and thus, the wrench tips cannot engage the nut. Also, some wrenches with arcuate drive surfaces require the wrench head to be larger than a conventional wrench head to withstand the stresses involved in driving a nut. The larger head requires a larger and generally more expensive blank from which to make the wrench. Furthermore, the larger head cannot fit in as small of a space as that of a conventional wrench.

DISCLOSURE OF INVENTION

The wrench of this invention has a head with an upper forward drive face opposed to a lower drive face and an upper rearward drive face adjacent to the upper forward drive face. An upper notch separates the upper forward drive face and the upper rearward drive face. There is a back stop face adjacent to the upper rearward drive face. The lower drive face is adapted to engage a first side of a nut, the upper rearward drive face is adapted to engage an opposed second side of the nut, and the back stop face is adapted to engage a corner of the nut when the wrench is in a primary drive position. The upper forward drive face is adapted to engage the first side of the nut, the upper notch is adapted to engage a nut corner adjacent to the first side, and the lower drive face is adapted to engage the second side when the wrench is in a secondary drive position.

Preferably, the lower drive face comprises a lower rearward drive face opposed to the upper rearward drive face, a lower forward drive face opposed to the upper forward drive face, and a lower notch located between the lower forward drive face and the lower rearward drive face. The drive faces may be convex arcuate. It may be preferable that the lower forward drive face be substantially a mirror image of the upper forward drive face. In addition, it may also be preferable that the lower rearward drive face is substantially a mirror image of the upper forward drive face.

DETAILED DESCRIPTION OF THE INVENTION

Figure 1:
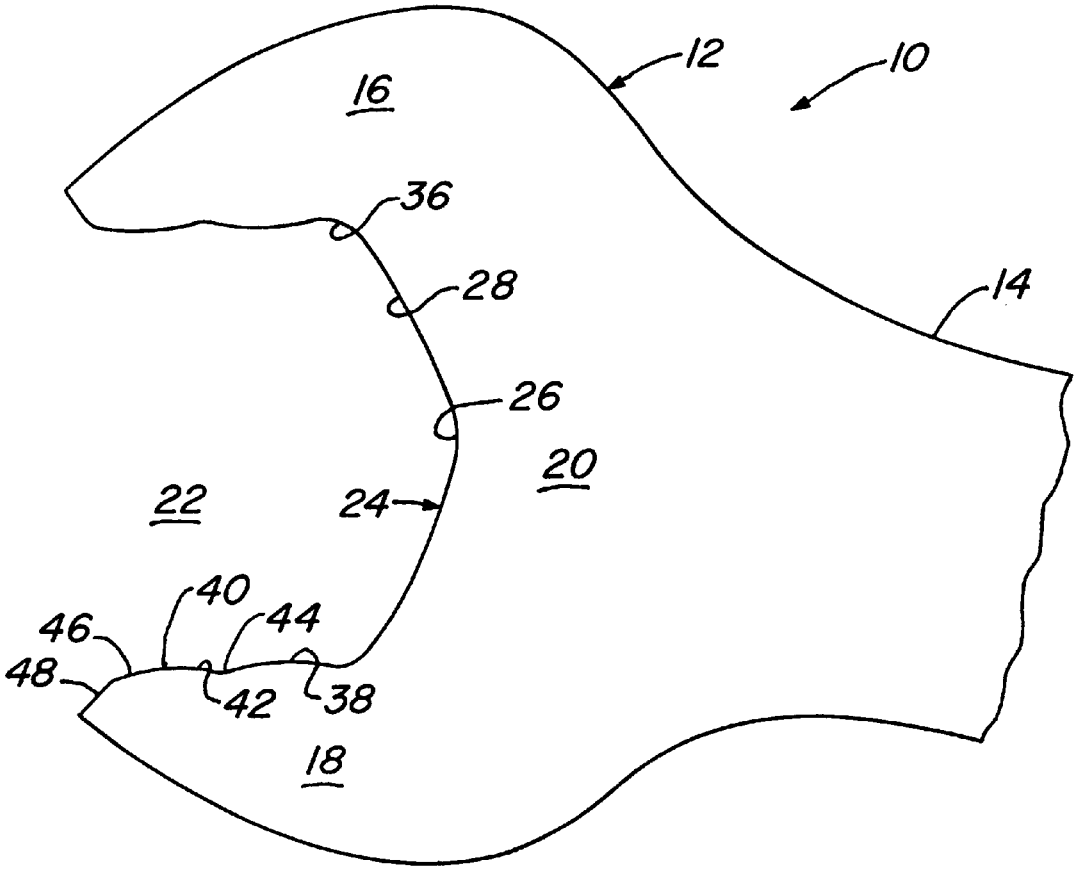
FIG. 1 is a top plan view of an open-end wrench constructed in accordance with the invention.
Figure 2:
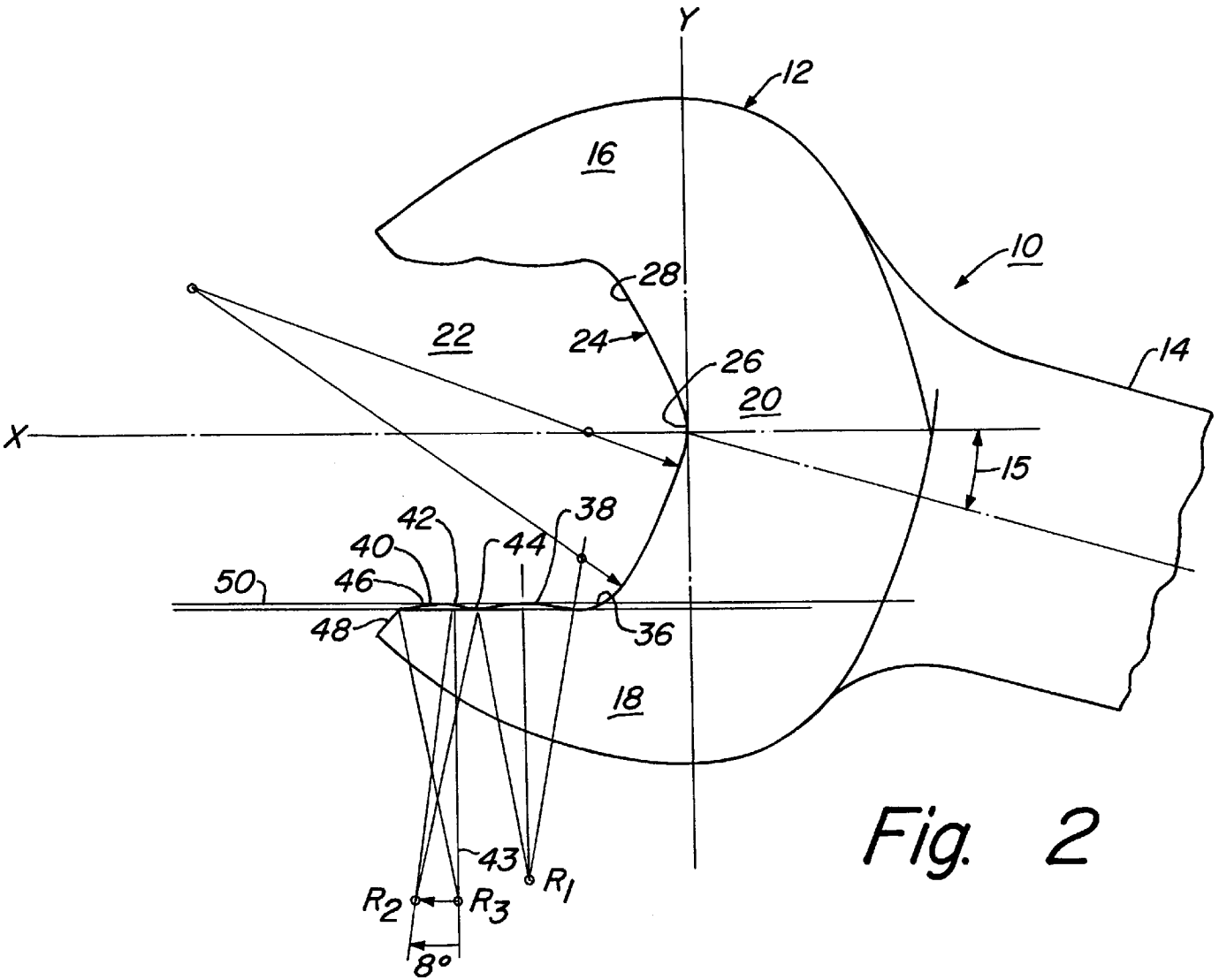
FIG. 2 is a top plan view of the wrench of FIG. 1, shown with further details of the jaw faces of the wrench.

FIG. 1 shows a wrench 10 having an open-end wrench head 12 joined to a handle 14. The wrench head 12 has fixed upper and lower jaws 16, 18. The jaws 16, 18 are spaced apart and rigidly joined together at their rearward ends by a web 20. The spaced jaws 16, 18 define a nut slot 22. As shown in FIG. 2, the wrench head 12 is bisected by a horizontal center line or axis X. Handle 14 is located on an angle 15 of about 15° relative to axis X.

Located at the very rearward end of the slot 22 of the wrench head 12 is a back stop 24. Back stop 24 is formed with a corner stop face 26. The corner stop face 26 is a concave surface having a radius of curvature of about 0.5565 inches or 0.278×N, where N is the maximum width of the nut to be driven. Unless otherwise stated, specific dimensions given for the wrench head are for use with hexagonal nuts where the maximum nut size is two inches as measured from flat to flat. References to the nut and relative positions are also with respect to the maximum size nut. Such references and dimensions are given for ease of description and understanding purposes only and should in no way be construed as limitations. It should be readily apparent to those skilled in the art that these dimensions will vary from wrench to wrench depending on the size of the nut it is designed for. The curvature and shape of the faces described herein is the substantially the same through any cross section of the wrench head 12 throughout its thickness. A vertical tangent line or axis Y (FIG. 2) passes through the apex of corner stop face 26 where it intersects the line X. Axis Y is perpendicular to axis X.

The radius of curvature for stop face 26 has its point of origin located on line X. Corner stop face 26 is bisected by the line X and merges on either side with a rear clearance face 28 of the jaws 18, 20. Clearance faces 28 of each jaw 16, 18 are concave surfaces having a radius of curvature of about 1.575×N. Concave surfaces 28 are generally oriented so that tangent lines passing through the apex of each curved surface 28 are at an angle of about 120° to each other.

Figure 3:
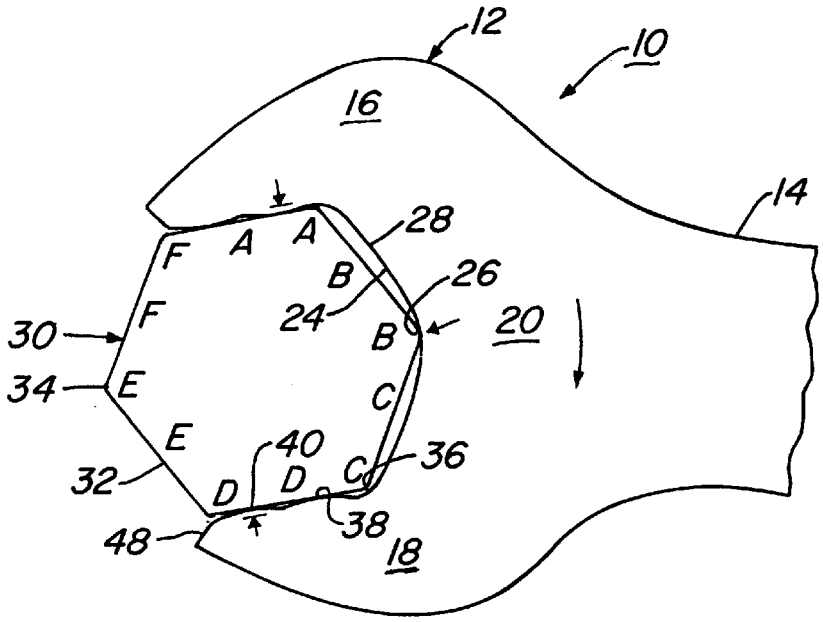
FIG. 3 is a top plan view of the wrench of FIG. 1, shown engaged with a nut in a primary drive position.

FIG. 3 shows the wrench head 12 engaged in a first or primary drive position with a nut 30. The nut 30 has six sides or flats 32 with adjacent flats intersecting at approximately 120° to form comers 34. The individual flats 32 and corners 34 of the nut 30 are each designated with an A, B, C, D, E or F for ease of description. As shown in FIG. 3, the concave surfaces 28 generally coextend along adjoining nut flats 32B and 32C of the nut 30, with the corner 34B abutting against the comer face 26, generally along the line X.

Referring again to FIG. 2, each clearance face 28 merges at the opposite end with a concave fillet 36. Each fillet 36 has a radius of curvature of about 0.188×N. The fillets 36 of jaws 16, 18 provide a clearance for the comers 34A, 34C, respectively, when in the first drive position. Each fillet 36 merges into a rearward drive face 38. It should be understood that the jaw surfaces of each of the jaws 16, 18 are identical mirror images of each other on either side of the bisecting line X. Thus, for ease of description purposes, unless otherwise stated, the description applied to the lower jaw 18 should be understood as applying to the upper jaw 16 as well. Also, the words "upper" and "lower" are used arbitrarily.

Each rearward drive face 38 is a convex arcuate surface having a radius of curvature R1 of 1.6250 inches or 0.8125×N. The rearward drive face 38 begins at a point located approximately 0.7365 inches or 0.3683×N from the vertical axis Y and terminates at a position 1.238 inches from Y. The radius of curvature R1 has a point of origin located along a vertical line located 2.63 inches or 1.315×N from the Y axis. The apex of the drive face 38 is also located along this line.

Adjoined to the forward end of each rearward drive face 38 is a forward drive face 40. Each forward drive face 40 has a rearward portion 42 that is a convex arcuate surface having a radius of curvature R2 of about 1.75 inches or 0.875×N. The rearward portion 42 terminates at its forward end at a position 1.413 inches or 0.7065×N from the Y axis. The point of origin for the radius R2 is located 8° forward from a vertical line 43 extended from the forward end of the rearward portion 42. The junction of the rearward drive face 38 and the rearward portion 42 of the drive face 40 forms a notch 44. The distance from the backstop face to the notch is approximately 0.62×N. The forward end of the rearward drive face 38 forms a forward-facing catch face when the wrench head 12 is in the secondary drive position shown in FIG. 4.

Forward drive face 40 has a forward portion 46 that adjoins the forward end of the rearward portion 42. Forward portion 46 is a convex arcuate surface having a radius of curvature R3 of about 1.75 inches or 0.875×N. The point of origin for radius R3 is located on the vertical line 43, which also coincides with the apex of the drive face 40. Drive face 40 terminates at a distance of about 1.759 inches or 0.8795×N from the Y axis.

An end face 48 extends from the forward end of each drive face 40. The end face 48 is a flat surface that slopes downward from the drive face 40 at an angle of about 45° from the X axis.

Referring to FIG. 2, each of the drive surfaces 38 and 40 has an apex or uppermost point located along a tangent line 50 which is parallel to axis X. This line 50 is spaced above the lowermost point of the notch 44 a distance of 0.0280 inches or 0.014×N. The vertical distance from the line 50 to the apices of the drive faces 38, 40 of the upper jaw 16 is 2.01 inches.

In operation, the wrench 10 can be used in two different drive positions. In a rearward or primary drive position, the nut 30 is slid rearward into the slot 22 so that comer 34B contacts corner stop face 26 of the backstop 24, thus preventing further rearward movement. In the primary drive position, the rear faces 28 do not contact the nut 30. The wrench head 12 naturally assumes the first drive position when the wrench head 12 is rotated, as shown in FIG. 3. For illustrative purposes, only clockwise rotation is shown in relation to the nut 30. The engagement of the jaw faces of jaws 16, 18 would be just the opposite for reverse or counter clockwise rotation.

In the primary drive position, the forward drive face 40 of lower jaw 18 contacts the forward portion of nut flat 32D and rear drive face 38 of upper jaw 16 contacts the rearward portion of nut flat 32A. When the wrench 10 is in the primary drive position, forward movement of the wrench head 12 is prevented by engagement of the nut 30 with the corner stop 26. Clockwise torque is applied to the nut 30 along the flats 32A, 32D through rearward drive face 38 and forward drive face 44 of upper and lower jaws 16, 18, respectively.

Figure 4:
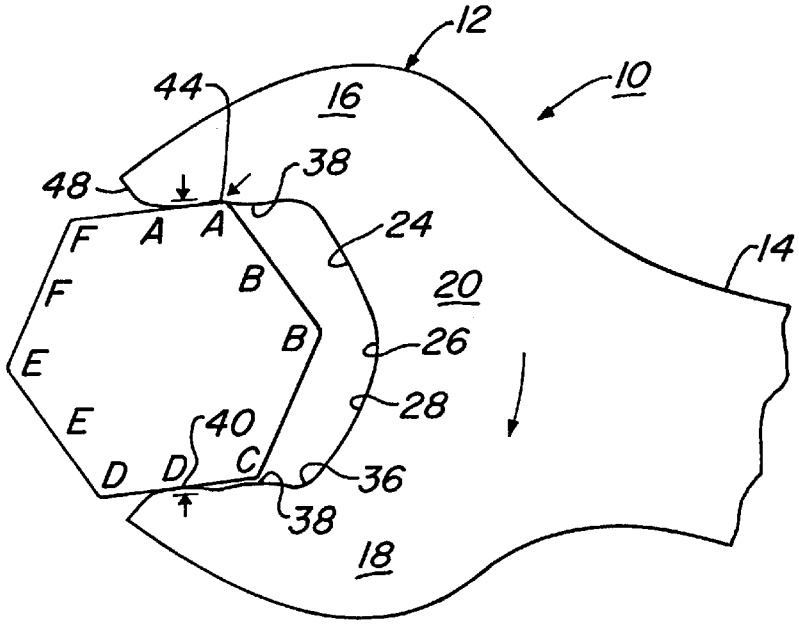
FIG. 4 is another top plan view of the wrench of FIG. 1, shown engaged with a nut in a secondary drive position.

Referring to FIG. 4, the wrench 10 is shown engaged with the nut 30 in a secondary drive position. In the secondary drive position, the nut 30 is spaced slightly forward from the backstop 24. Torque is applied through the directly opposing forward drive faces 40 of the upper and lower jaws 16, 18. During clockwise torque, the forward drive face 40 of the upper jaw 16 contacts the nut flat 32A, and the forward drive face 40 of the lower jaw 18 contacts the nut flat 32D. Forward movement of the wrench 10 is prevented by contact of the nut corner 34A with the forward end of the rearward drive face 38 of upper jaw 16 at the junction 43. This facilitates maintaining the wrench head 12 in the forward drive position.

There are several significant advantages to this invention. The arcuate drive surfaces of the wrench contact only the nut sides; therefore, torque is applied to the nut sides and not the corners in both drive positions. This prevents rounding off of the corners as occurs with conventional flat-jaw-faced wrenches. The long radius arcuate drive surfaces of this wrench assume large surface-to-surface drive surface contact with the nut in both drive positions. This protects the nut flats from cut and dent damage that can occur with other wrenches that drive the nut on the flats with very short radius curved surfaces or sharp edge driving contacts. The catch faces help to maintain the wrench head in position on the nut when torque is applied. The wrench head has two distinct drive positions allowing a nut to be driven with the wrench fully seated on the nut or just with the wrench tips. The second drive position permits a nut to be driven more quickly because the wrench does not have to be fully seated before each stroke. Further, this invention can be used in situations where space constraints do not allow the wrench to seat fully on the nut. The head of this invention can be smaller than other wrenches with arcuate drive surfaces, thus saving on the cost of the manufacturing blank. The smaller head also allows the wrench to be used in situations where the head of other wrenches may be too large.

While the invention has been shown in only one of its forms, it should be apparent to those skilled in the art that it is not so limited, but is susceptible to various changes without departing from the scope of the invention.

I claim:

1. A wrench having a head adapted for use with a hexagonal nut, the head comprising:

an upper forward drive face opposed to a lower drive face, the upper forward drive face and lower drive face being stationarily spaced apart from each other a first distance for closely receiving opposed sides of a nut;

an upper rearward drive face adjacent to the upper forward drive face;

an upper notch separating the upper forward drive face and the upper rearward drive face;

a back stop face adjacent to the upper rearward drive face and spaced such that a second distance measured along a line bisecting the wrench head from the back stop face to the upper notch is substantially less than 90% of the first distance;

wherein, the lower drive face is adapted to engage a first side of the nut, the upper rearward drive face is adapted to engage an opposed second side of the nut, and the back stop face is adapted to engage a corner of the nut when the wrench is in a primary drive position; and the upper forward drive face is adapted to engage the first side of the nut, the upper notch is adapted to engage a nut corner adjacent to the first side, and the lower drive face is adapted to engage the second side when the wrench is in a secondary drive position.

2. The wrench of claim 1 wherein the lower drive face comprises:

a lower forward drive face opposed to the upper forward drive face;

a lower rearward drive face opposed to the upper rearward drive face; and a lower notch located between the lower forward drive face and the lower rearward drive face;

wherein a distance from the back stop face to the lower notch is substantially less than 90% of the first distance.

3. The wrench of claim 2 wherein the lower forward drive face is substantially a mirror image of the upper forward drive face.

4. The wrench of claim 3 wherein the lower rearward drive face is substantially a mirror image of the upper rearward drive face.

5. The wrench of claim 4 wherein all of the drive faces are convex and arcuate.

6. The wrench of claim 5 wherein the forward drive faces have approximately the same radius of curvature and same arc length as the rearward drive faces.

7. The wrench of claim 2 wherein a distance between the upper forward drive face and the lower forward drive face is the same as a distance between the upper rearward drive face and the lower rearward drive face.

8. The wrench of claim 1 wherein the second distance is less than 70% of the length of the first distance.

9. The wrench of claim 1 wherein the second distance is greater than 50% of the length of the first distance.

10. The wrench of claim 1 wherein the forward and rearward drive faces are curved, each having a mid point, a tangent line to both of the mid points being located on a line parallel to a line bisecting the head.

11. A wrench for use with a hexagonal nut, comprising:

an upper jaw spaced apart from a lower jaw, the upper jaw terminating in an end face and being rigidly formed with the lower jaw such that the jaws are immovable relative to each other;

a forward drive face located on the upper jaw adjacent to the end face and generally facing the lower jaw;

a rearward drive face located on the upper jaw adjacent to the forward drive face and generally facing the lower jaw;

an upper notch formed at a junction of the forward drive face and the rearward drive face;

the lower jaw being substantially a mirror image of the upper jaw, having a forward drive face, a rearward drive face, and a lower notch formed at a junction of the forward and rearward drive faces of the lower jaw, the upper and lower forward drive faces being spaced apart from each other a first distance for closely receiving opposed sides of a nut;

a back stop face joining the rearward drive face of the upper jaw and the rearward drive face of the lower jaw and spaced such that a second distance measured along a line bisecting the wrench head from the back stop face to the upper notch is substantially less than 90% of the first distance;

wherein, the forward drive face of the lower jaw and the rearward drive face of the upper jaw are adapted to engage opposing sides of a nut and the back stop face is adapted to engage a corner of the nut when the wrench is in a primary drive position; and the forward drive faces are adapted to engage opposing sides of the nut and the notch of the upper jaw is adapted to engage an adjacent corner of the nut when the wrench is in a secondary drive position.

12. The wrench of claim 11 wherein the drive faces are concave arcuate.

13. The wrench of claim 12 wherein the forward drive faces have approximately the same radius of curvature and arc length as the rearward drive faces.

14. The wrench of claim 11 wherein the second distance is less than 70% the length of the first distance.

15. The wrench of claim 11 wherein the second distance is greater than 50% of the first distance.

16. The wrench of claim 11 wherein the forward and rearward drive faces are curved, each having a mid point, a tangent line to both of the mid points being located on a line parallel to a line bisecting the head.

17. The wrench of claim 11 wherein a distance between the upper rearward drive face and the lower rearward drive face is substantially the same as the first distance.

* * * * *